US011615698B1

(12) United States Patent
Davis et al.

(10) Patent No.: US 11,615,698 B1
(45) Date of Patent: Mar. 28, 2023

(54) EMERGENCY RESPONDER ALERT ASSEMBLY

(71) Applicants: Danny Davis, Franklin, GA (US); Thomas Prescott, Franklin, GA (US)

(72) Inventors: Danny Davis, Franklin, GA (US); Thomas Prescott, Franklin, GA (US)

( * ) Notice: Subject to any disclaimer, the term of this patent is extended or adjusted under 35 U.S.C. 154(b) by 0 days.

(21) Appl. No.: 17/563,160

(22) Filed: Dec. 28, 2021

(51) Int. Cl.
*G08B 27/00* (2006.01)
*G08B 25/00* (2006.01)
*G08B 25/10* (2006.01)

(52) U.S. Cl.
CPC ..... *G08B 27/001* (2013.01); *G08B 25/006* (2013.01); *G08B 25/10* (2013.01)

(58) Field of Classification Search
CPC ..... G08B 27/001
See application file for complete search history.

(56) References Cited

U.S. PATENT DOCUMENTS 4,901,461 A 2/1990 Edwards
5,155,470 A 10/1992 Tuttle
2007/0241922 A1* 10/2007 Brannon ..... G08B 7/064 340/691.1
2010/0265089 A1* 10/2010 Gregory ..... G08B 7/064 340/815.74
2016/0063824 A1 3/2016 Fiore

FOREIGN PATENT DOCUMENTS

WO WO2017030970 2/2017

* cited by examiner

*Primary Examiner* — Travis R Hunnings

(57) ABSTRACT

An emergency responder alert assembly includes an alert housing that is mountable at a location which is associated with a residence such that the alert housing is visible to emergency responders. A plurality of light emitters is provided and each of the light emitters is coupled to the alert housing for visually alerting the emergency responders that the residence is the location to which the emergency responders have been dispatched. A pendant actuate unit is movably integrated into a pendant and each of the light emitters is turned on when the pendant actuate unit is actuated by the user. A desktop actuate unit is in remote communication with the plurality of light emitters and each of the light emitters is turned on when the desktop actuate unit is actuated by the user.

5 Claims, 5 Drawing Sheets

EMERGENCY RESPONDER ALERT ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to alert devices and more particularly pertains to a new alert device for visually alerting emergency responders to the location of a residence to which the emergency responders have been dispatched. The device includes a plurality of light emitters which are each disposed on a residence. The device includes a pendant actuating unit that can be worn on a necklace and a desktop actuate unit that is positionable on a support surface. Each of the pendant actuate unit and the desktop actuate unit are in wireless communication with the plurality of light emitters. Furthermore, either the pendant actuate unit or the desktop actuate unit are actuated when a user calls 911 such that the light emitters are turned on to assist emergency responders with identifying the residence to which they have been dispatched.

(2) Description of Related Art Including Information Disclosed Under 37 CFR 1.97 and 1.98

The prior art relates to alert devices including an illuminated house number display and a button that is wired to the display to indicate an emergency condition when the display is turned on. The prior art discloses a rural mailbox device that includes a stanchion extending upwardly from a mailbox and a light emitter disposed on an upper end of the stanchion which is illuminated during an emergency. The prior art discloses an emergency mailbox device that includes an illuminated panel which is actuated to indicate an emergency at a residence. The prior art discloses a light system which is illuminated to indicate a location to which emergency vehicles have been dispatched.

BRIEF SUMMARY OF THE INVENTION

An embodiment of the disclosure meets the needs presented above by generally comprising an alert housing that is mountable at a location which is associated with a residence such that the alert housing is visible to emergency responders. A plurality of light emitters is provided and each of the light emitters is coupled to the alert housing for visually alerting the emergency responders that the residence is the location to which the emergency responders have been dispatched. A pendant actuate unit is movably integrated into a pendant and each of the light emitters is turned on when the pendant actuate unit is actuated by the user. A desktop actuate unit is in remote communication with the plurality of light emitters and each of the light emitters is turned on when the desktop actuate unit is actuated by the user.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
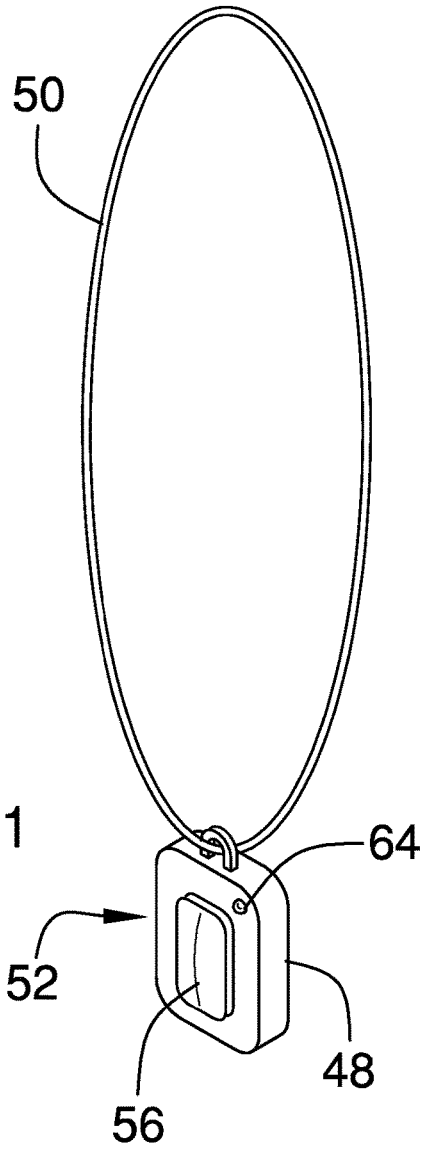
FIG. 1 is a perspective view of a pendant actuate unit of an embodiment of the disclosure.
Figure 2:
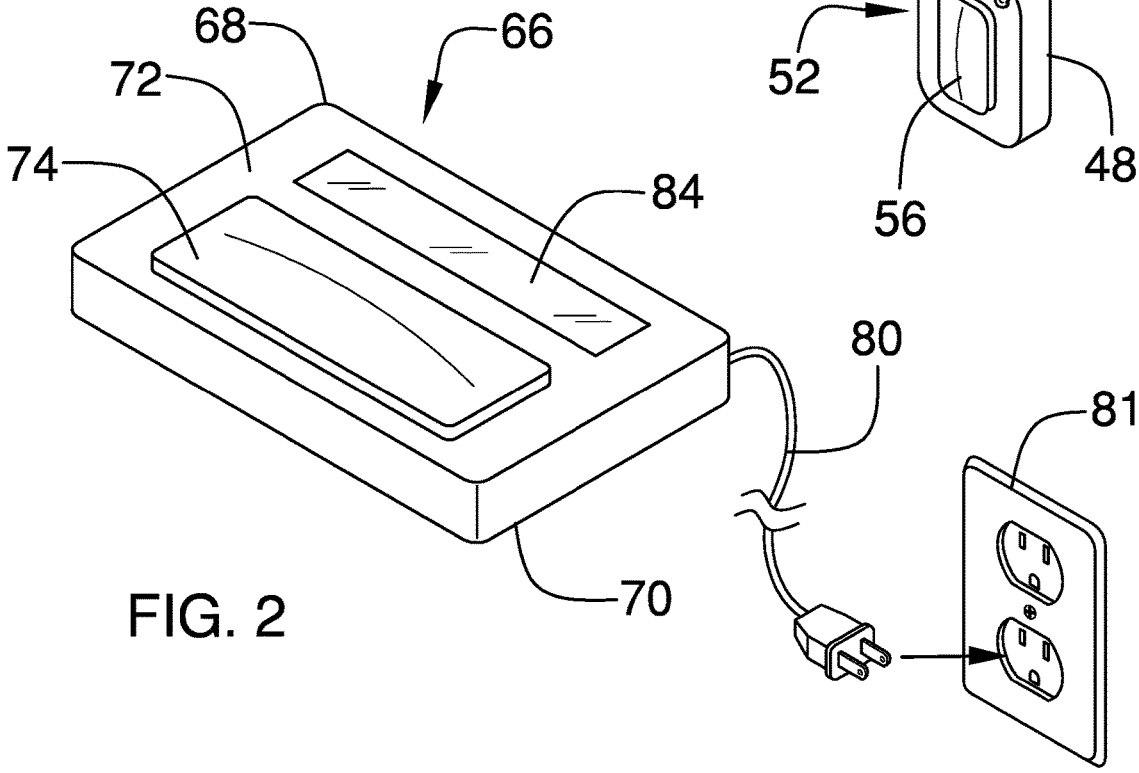
FIG. 2 is a perspective view of desktop actuate unit of an embodiment of the disclosure.
Figure 3:
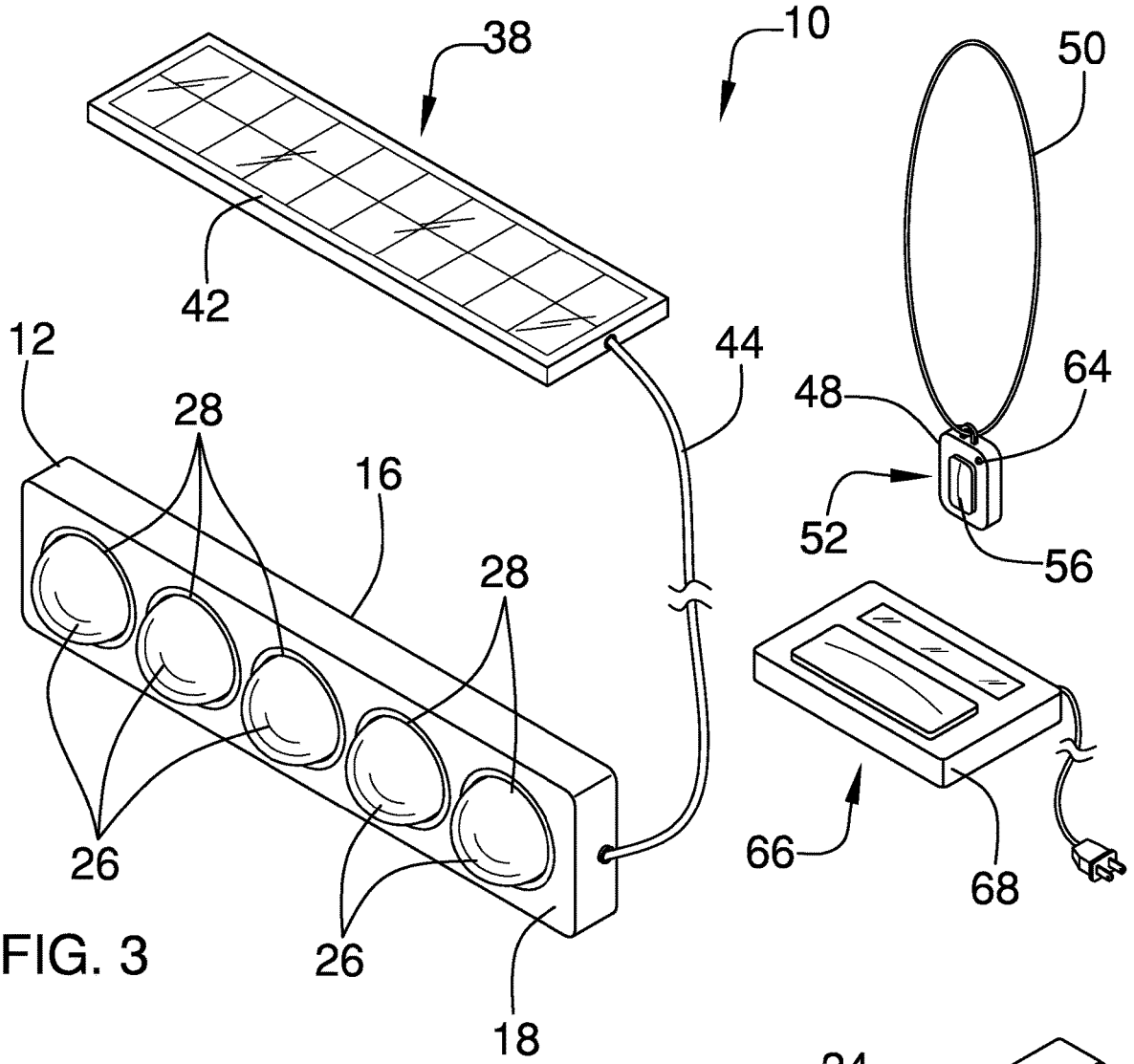
FIG. 3 is a perspective view of an emergency responder alert assembly according to an embodiment of the disclosure.
Figure 4:
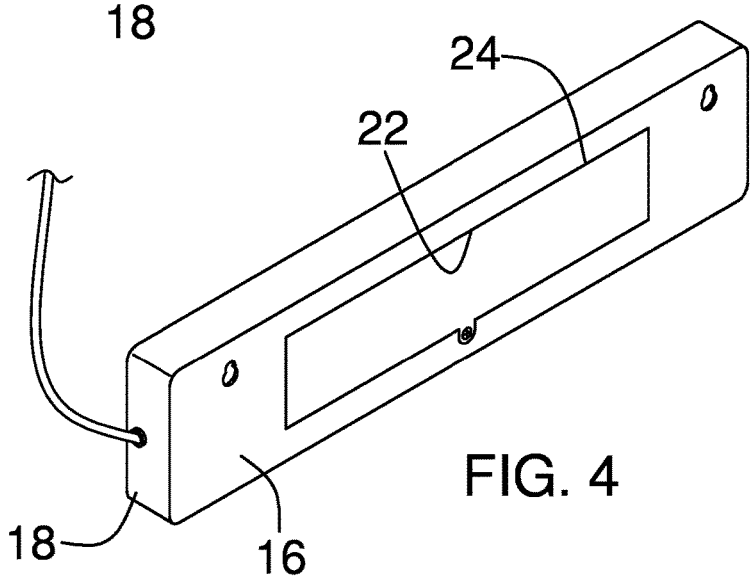
FIG. 4 is a back perspective view of alert housing of an embodiment of the disclosure.
Figure 5:
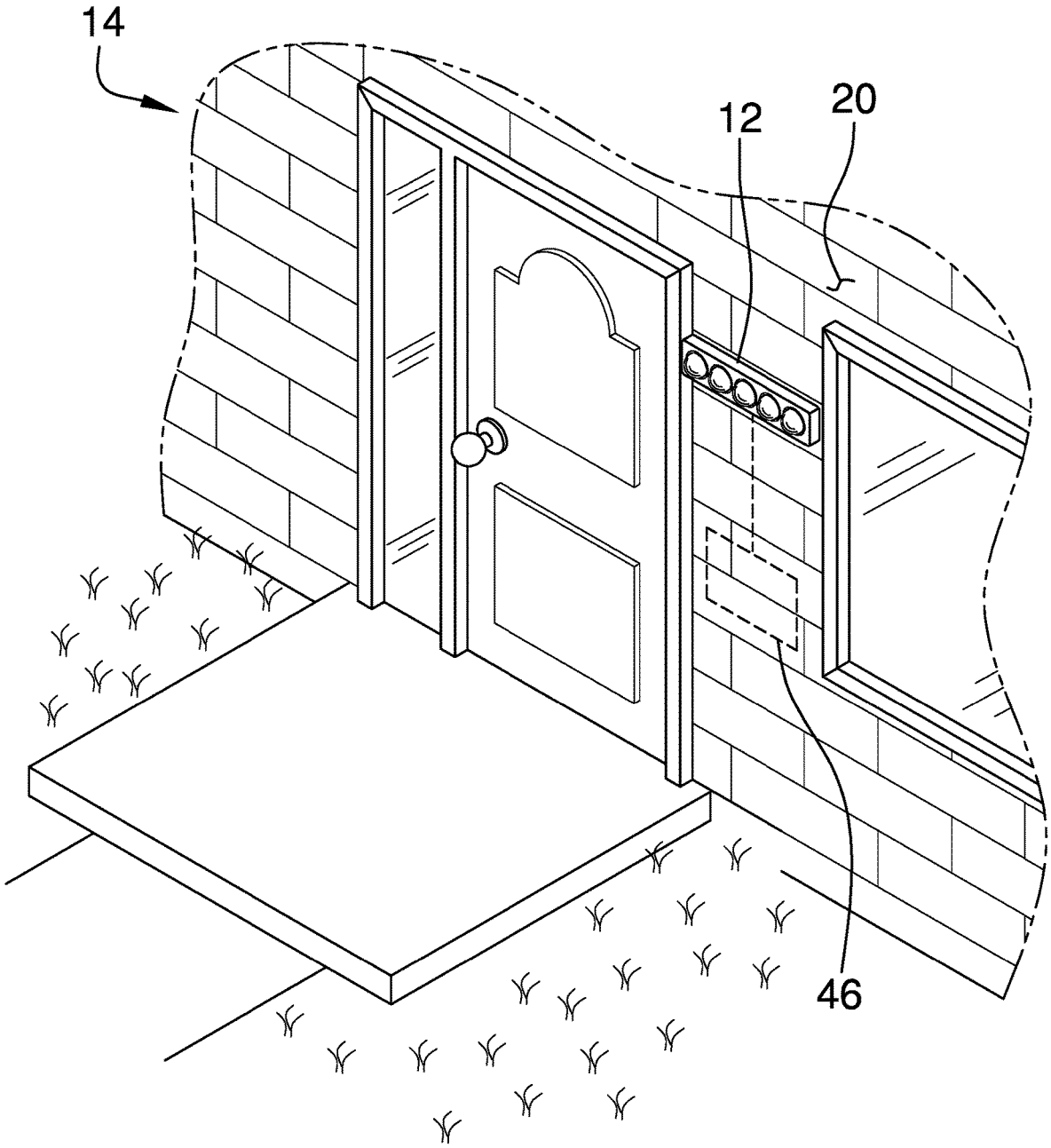
FIG. 5 is an exterior in-use view of an embodiment of the disclosure.
Figure 6:
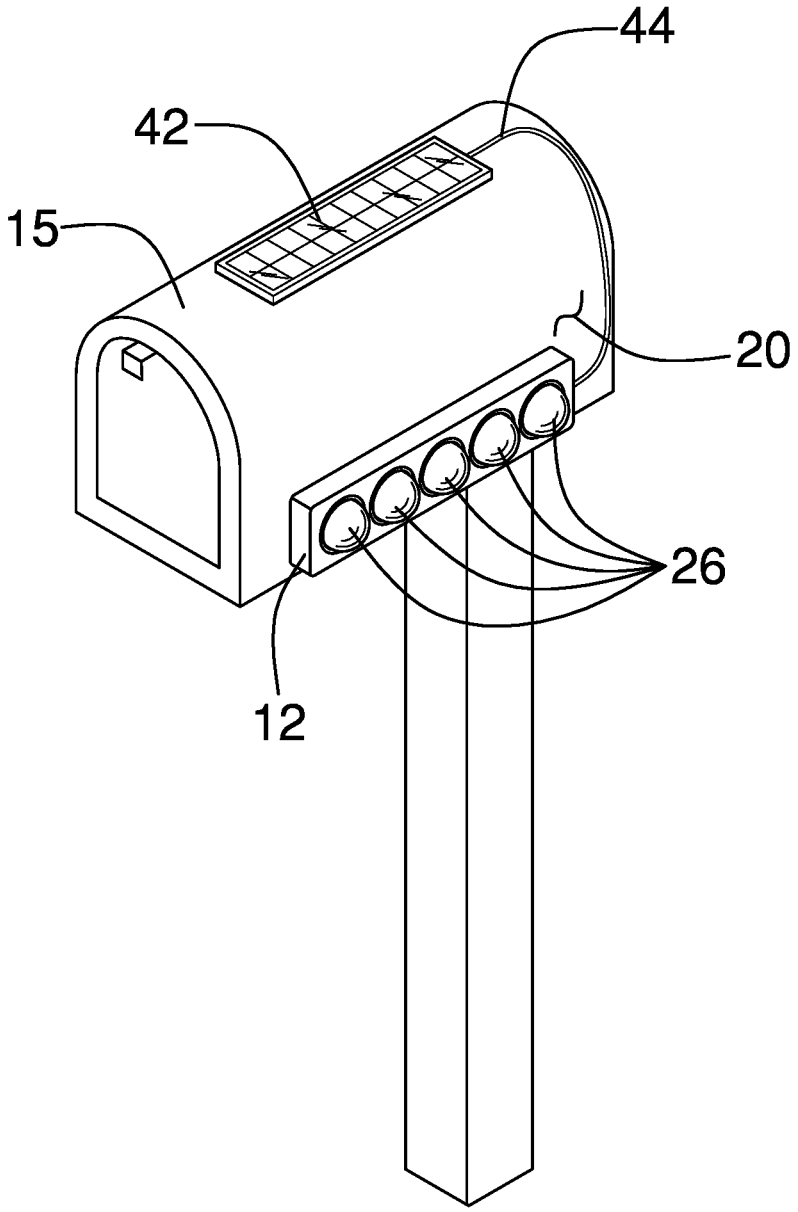
FIG. 6 is a perspective view of an embodiment of the disclosure.
Figure 7:
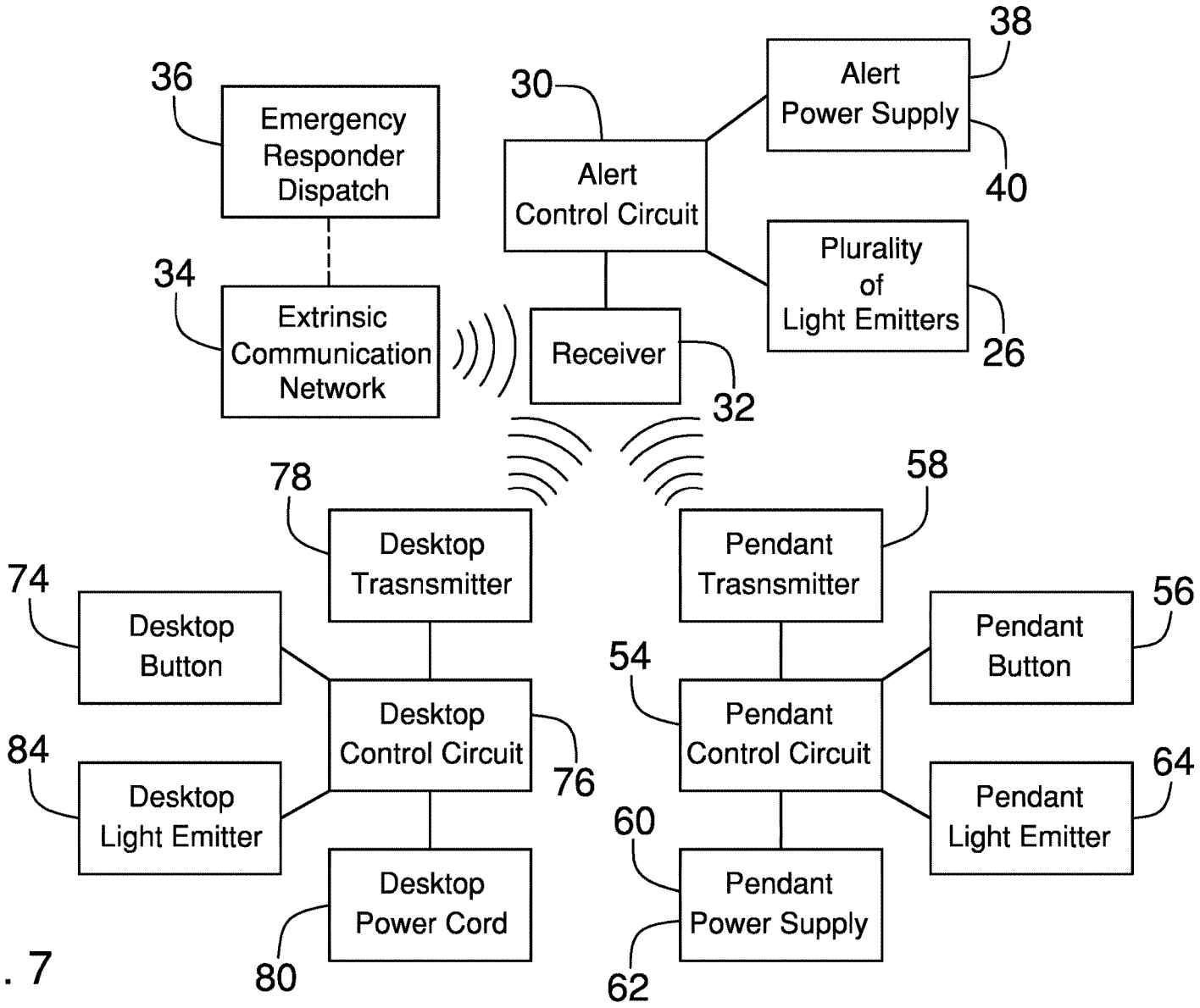
FIG. 7 is a schematic view of an embodiment of the disclosure.

With reference now to the drawings, and in particular to FIGS. 1 through 7 thereof, a new alert device embodying the principles and concepts of an embodiment of the disclosure and generally designated by the reference numeral 10 will be described.

As best illustrated in FIGS. 1 through 7, the emergency responder alert assembly 10 generally comprises an alert housing 12 that is mountable at a location which is associated with a residence 14. In this way the alert housing 12 is visible to emergency responders. The residence 14 may be a house, an apartment complex or any other type of residence to which emergency responders may be dispatched. The emergency responders may be police officers, firemen, or emergency medical technicians. As is most clearly shown in FIG. 6, the alert housing 12 may be positioned on a mailbox 15 that is associated with the residence. The alert housing 12 has a back wall 16 and a front wall 18, and the back wall 16 is mounted to a vertical support surface 20. The back wall 16 has a battery opening 22 extending into an interior of the alert housing 12 and a battery cover 24 is removably attached to the back wall 16 which covers the battery opening 22.

A plurality of light emitters 26 is provided and each of the light emitters 26 is coupled to the alert housing 12. Each of the light emitters 26 emits light outwardly from the alert housing 12 for visually alerting the emergency responders that the residence 14 is the location to which the emergency responders have been dispatched. Each of the light emitters 26 is positioned on the front wall 18 of the alert housing 12. The light emitters 26 are spaced apart from each other and are distributed along a full width of the alert housing 12. Additionally, each of the light emitters 26 includes a lens 28 that is convexly arcuate with respect to the front wall 18. Each of the light emitters 26 may comprise a light emitting diode or other similar type of electronic light emitter.

An alert control circuit 30 is integrated into the alert housing 12 and the alert control circuit 30 is electrically coupled to each of the light emitters 26. The alert control circuit 30 receives an alert input and each of the light emitters 26 is actuated to alternatively flash on and off when the alert control circuit 30 receives the alert input. The alert control circuit 30 receives a de-actuate input and each of the light emitters 26 is de-actuated when the alert control circuit 30 receives the de-actuate input.

A receiver 32 is integrated into the alert housing 12 and the receiver 32 is electrically coupled to the alert control circuit 30. The receiver 32 is in wireless communication with an extrinsic communication network 34 thereby facilitating the receiver 32 to be in communication with an emergency responder dispatch 36. The receiver 32 may comprise a radio frequency receiver or the like. Additionally, the extrinsic communication network 34 may comprise the internet, a cellular phone network or any other type of wireless communication network. The alert control circuit 30 receives the alert input when an occupant of the residence 14 contacts the emergency responder dispatch 36.

An alert power supply 38 is integrated into the alert housing 12 and the alert power supply 38 is electrically coupled to the alert control circuit 30. The alert power supply 38 comprises a rechargeable battery 40 that is positioned within the alert housing 12 and the rechargeable battery 40 is positioned beneath the battery cover 24. The rechargeable battery 40 is electrically coupled to the alert control circuit 30. The alert power supply 38 includes a solar panel 42 that is remotely positioned with respect to the alert housing 12 such that the solar panel 42 is exposed to sunlight. The alert power supply 38 includes a conductor 44 which is coupled between the solar panel 42 and the alert housing 12. The conductor 44 is electrically coupled to the rechargeable battery 40 such that the solar panel 42 charges the rechargeable battery 40. As is most clearly shown in FIG. 5, the alert control circuit 30 may be electrically coupled to a power source 46 comprising an electrical system of the residence 14 to which the alert housing 12 is attached.

A pendant 48 is provided and the pendant 48 is suspended from a necklace 50 such that the pendant 48 can be suspended from a neck of a user, and the pendant 48 has a forward face 50. A pendant actuate unit 52 is movably integrated into the pendant 48 such that the pendant actuate unit 52 can be manipulated by the user. The pendant actuate unit 52 is in remote communication with the plurality of light emitters 26. Furthermore, each of the light emitters 26 is turned on when the pendant actuate unit 52 is actuated by the user.

The pendant actuate unit 52 comprises a pendant control circuit 54 that is integrated into the pendant 48, and the pendant control circuit 54 receives a broadcast input. The pendant actuate unit 52 includes a pendant button 56 that is movably integrated into the forward face 50 of the pendant 48. The pendant button 56 is electrically coupled to the pendant control circuit 54. Furthermore, the pendant control circuit 54 receives the broadcast input when the pendant button 56 is depressed.

The pendant actuate unit 52 includes a pendant transmitter 58 that is integrated into the pendant 48, and the pendant transmitter 58 is electrically coupled to the pendant control circuit 54. The pendant transmitter 58 is in wireless communication with the receiver 32 in the alert housing 12. Moreover, the pendant transmitter 58 broadcasts an alert signal to the receiver 32 when the pendant control circuit 54 receives the broadcast input. The alert control circuit 30 receives the alert input when the receiver 32 receives the alert signal from the pendant transmitter 58. The pendant transmitter 58 may comprise a radio frequency transmitter or the like and the pendant transmitter 58 may operate on a frequency that is specific to an operational frequency of the receiver 32. In this way the pendant transmitter 58 will communicate only with the receiver 32 in the alert housing 12.

The pendant actuate unit 52 includes a pendant power supply 60 that is positioned within the pendant 48. The pendant power supply 60 is electrically coupled to the pendant control circuit 54 and the pendant power supply 60 comprises at least one battery 62. The pendant actuate unit 52 includes a pendant light emitter 64 that is coupled to the forward face 50 of the pendant 48. The pendant light emitter 64 is electrically coupled to the pendant control circuit 54 and the pendant light emitter 64 is turned on when the pendant control circuit 54 receives the broadcast input. In this way the pendant light emitter 64 facilitates a visual cue that the pendant button 56 has been depressed.

A desktop actuate unit 66 is provided which is positionable on a horizontal support surface 68 such that the desktop actuate unit 66 is accessible to the user. The desktop actuate unit 66 is in remote communication with the plurality of light emitters 26 and each of the light emitters 26 is turned on when the desktop actuate unit 66 is actuated by the user. The desktop actuate unit 66 comprises a desktop housing 68 that has a lower wall 70 and an upper wall 72, and the lower wall 70 rests on the horizontal support surface 68. The desktop actuate unit 66 includes a desktop button 74 that is movably integrated into the upper wall 72 such that the desktop button 74 can be manipulated by the user. The desktop actuate unit 66 includes a desktop control circuit 76 that is integrated into the desktop housing 68. The desktop button 74 is electrically coupled to the desktop control circuit 76 and the desktop control circuit 76 receives a broadcast input when the desktop button 74 is depressed.

The desktop actuate unit 66 includes a desktop transmitter 78 that is integrated into the desktop housing 68, and the desktop transmitter 78 is electrically coupled to the desktop control circuit 76. The desktop transmitter 78 is in wireless communication with the receiver 32 in the alert housing 12. Moreover, the desktop transmitter 78 broadcasts an alert signal when the desktop control circuit 76 receives the broadcast input. The alert control circuit 30 receives the alert input when the receiver 32 receives the alert signal from the desktop transmitter 78. The desktop transmitter 78 may comprise a radio frequency transmitter or the like and the desktop transmitter 78 may operate on a frequency that is specific to the operational frequency of the receiver 32. In this way the desktop transmitter 78 will communicate only with the receiver 32.

The desktop actuate unit 66 includes a desktop power cord 80 that is coupled to and extends away from the desktop housing 68. The desktop power cord 80 is electrically coupled to the desktop control circuit 76 and the desktop power cord 80 can be plugged into a power source 81 comprising a female electrical outlet. The desktop actuate unit 66 includes a desktop light emitter 84 that is coupled to the upper wall 72 of the desktop housing 68. The desktop light emitter 84 is electrically coupled to the desktop control circuit 76 and the desktop light emitter 84 is turned on when the desktop control circuit 76 receives the broadcast input. Additionally, the desktop light emitter 84 may comprise a light emitting diode strip.

In use, either the pendant button 56 is depressed or the desktop button 74 is depressed when the user calls 911, depending upon the user's preference or proximity to the desktop alert unit. Thus, the light emitters 26 are turned on facilitating the emergency responders to quickly and easily identify the residence 14 to which they have been dispatched. In this way the emergency responders will not waste time attempting to locate the residence 14 when the residence 14 is located in a confusing neighborhood, for example. Additionally, the emergency responder dispatch 36 can remotely actuate the light emitters 26 through the receiver 32 when the user calls 911. In this way the light emitters 26 are actuated regardless if the user depresses the pendant button 56 or the desktop button 74. Furthermore, the emergency responder dispatch 36 remotely de-actuates the light emitters 26 when the emergency responder arrives at the residence 14 to which the emergency responders have been dispatched.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. An emergency responder alert assembly for visually identifying a location to which emergency responders have been called, said assembly, comprising:

an alert housing being mountable at a location being associated with a residence wherein said alert housing is configured to be visible to emergency responders, said alert housing having a back wall and a front wall, said back wall being mounted to a vertical support surface;

a plurality of light emitters, each of said light emitters being coupled to said alert housing wherein each of said light emitters is configured to emit light outwardly from said alert housing for visually alerting the emergency responders that the residence is the location to which the emergency responders have been dispatched, each of said light emitters being positioned on said front wall of said alert housing, said light emitters being spaced apart from each other and are distributed along a full width of said alert housing, each of said light emitters including a lens being convexly arcuate with respect to said front wall;

an alert control circuit being integrated into said alert housing said alert control circuit being electrically coupled to each of said light emitters, said alert control circuit being programmed to receive an alert input, each of said light emitters being actuated to alternatively flash on and off when said alert control circuit receives said alert input, said alert control circuit being programmed to receive a de-actuate input, each of said light emitters being de-actuated when said alert control circuit receives said de-actuate input;

a receiver being integrated into said alert housing, said receiver being electrical coupled to said alert control circuit, said receiver being in wireless communication with an extrinsic communication network thereby facilitating said receiver to be in communication with an emergency responder dispatch, said receiver being programmed to receive an emergency signal from the emergency responder dispatch through the extrinsic communication network, said receiver transmitting said alert input to said alert control circuit when said receiver receives the emergency signal;

a pendant being suspended from a necklace wherein said pendant is configured to be suspended from a neck of a user, said pendant having a forward face;

a pendant actuate unit being movably integrated into said pendant wherein said pendant actuate unit is configured to be manipulated by the user, said pendant actuate unit being in remote communication with said plurality of light emitters, each of said light emitters being turned on when said pendant actuate unit is actuated by the user; and a desktop actuate unit being positionable on a horizontal support surface wherein said desktop actuate unit is configured to be accessible to the user, said desktop actuate unit being in remote communication with said plurality of light emitters, each of said light emitters being turned on when said desktop actuate unit is actuated by the user.

2. The assembly according to claim 1, further comprising an alert power supply being integrated into said alert housing, said alert power supply being electrically coupled to said alert control circuit, said alert power supply comprising:

a rechargeable battery being positioned within said alert housing, said rechargeable battery being electrically coupled to said alert control circuit;

a solar panel being remotely positioned with respect to said alert housing wherein said solar panel is configured to be exposed to sunlight; and a conductor being coupled between said solar panel and said alert housing, said conductor being electrically coupled to said rechargeable battery such that said solar panel charges said rechargeable battery.

3. The assembly according to claim 1, further comprising said pendant actuate unit comprising:

a pendant control circuit being integrated into said pendant, said pendant control circuit being programmed to receive a broadcast input;

a pendant button being movably integrated into said forward face of said pendant, said pendant button being electrically coupled to said pendant control circuit, said pendant control circuit receiving said broadcast input when said pendant button is depressed;

a pendant transmitter being integrated into said pendant, said pendant transmitter being electrically coupled to said pendant control circuit, said pendant transmitter being in wireless communication with said receiver in said alert housing, said pendant transmitter broadcasting an alert signal to said receiver when said pendant control circuit receives said broadcast input, said alert control circuit receiving said alert input when said receiver receives said alert signal from said pendant transmitter; and a pendant power supply being positioned within said pendant, said pendant power supply being electrically coupled to said pendant control circuit, said pendant power supply comprising at least one battery.

4. The assembly according to claim 1, wherein said desktop actuate unit comprises:

a desktop housing having a lower wall and an upper wall, said lower wall resting on the horizontal support surface;

a desktop button being movably integrated into said upper wall wherein said desktop button is configured to be manipulated by the user;

a desktop control circuit being integrated into said desktop housing, said desktop button being electrically coupled to said desktop control circuit, said desktop control circuit receiving a broadcast input when said desktop button is depressed;

a desktop transmitter being integrated into said desktop housing, said desktop transmitter being electrically coupled to said desktop control circuit, said desktop transmitter being in wireless communication with said receiver in said alert housing, said desktop transmitter broadcasting an alert signal when said desktop control circuit receives said broadcast input, said alert control circuit receiving said alert input when said receiver receives said alert signal from said desktop transmitter; and a desktop power cord being coupled to and extending away from said desktop housing, said desktop power cord being electrically coupled to said desktop control circuit, said desktop power cord being pluggable into a power source comprising a female electrical outlet.

5. An emergency responder alert assembly for visually identifying a location to which emergency responders have been called, said assembly comprising:

an alert housing being mountable at a location being associated with a residence wherein said alert housing is configured to be visible to emergency responders, said alert housing having a back wall and a front wall, said back wall being mounted to a vertical support surface;

a plurality of light emitters, each of said light emitters being coupled to said alert housing wherein each of said light emitters is configured to emit light outwardly from said alert housing for visually alerting the emergency responders that the residence is the location to which the emergency responders have been dispatched, each of said light emitters being positioned on said front wall of said alert housing, said light emitters being spaced apart from each other and are distributed along a full width of said alert housing, each of said light emitters including a lens being convexly arcuate with respect to said front wall;

an alert control circuit being integrated into said alert housing, said alert control circuit being electrically coupled to each of said light emitters, said alert control circuit being programmed to receive an alert input, each of said light emitters being actuated to alternatively flash on and off when said alert control circuit receives said alert input, said alert control circuit being programmed to receive a de-actuate input, each of said light emitters being de-actuated when said alert control circuit receives said de-actuate input;

a receiver being integrated into said alert housing, said receiver being electrically coupled to said alert control circuit, said receiver being in wireless communication with an extrinsic communication network thereby facilitating said receiver to be in communication with an emergency responder dispatch, said receiver being programmed to receive an emergency signal from the emergency responder dispatch through the extrinsic communication network, said receiver transmitting said alert input to said alert control circuit when said receiver receives the emergency signal; and an alert power supply being integrated into said alert housing, said alert power supply being electrically coupled to said alert control circuit, said alert power supply comprising:

a rechargeable battery being positioned within said alert housing, said rechargeable battery being electrically coupled to said alert control circuit;

a solar panel being remotely positioned with respect to said alert housing wherein said solar panel is configured to be exposed to sunlight; and a conductor being coupled between said solar panel and said alert housing, said conductor being electrically coupled to said rechargeable battery such that said solar panel charges said rechargeable battery;

a pendant being suspended from a necklace wherein said pendant is configured to be suspended from a neck of a user, said pendant having a forward face;

a pendant actuate unit being movably integrated into said pendant wherein said pendant actuate unit is configured to be manipulated by the user, said pendant actuate unit being in remote communication with said plurality of light emitters, each of said light emitters being turned on when said pendant actuate unit is actuated by the user, said pendant actuate unit comprising:

a pendant control circuit being integrated into said pendant, said pendant control circuit being programmed to receive a broadcast input;

a pendant button being movably integrated into said forward face of said pendant, said pendant button being electrically coupled to said pendant control circuit, said pendant control circuit receiving said broadcast input when said pendant button is depressed;

a pendant transmitter being integrated into said pendant, said pendant transmitter being electrically coupled to said pendant control circuit, said pendant transmitter being in wireless communication with said receiver in said alert housing, said pendant transmitter broadcasting an alert signal to said receiver when said pendant control circuit receives said broadcast input, said alert control circuit receiving said alert input when said receiver receives said alert signal from said pendant transmitter; and a pendant power supply being positioned within said pendant, said pendant power supply being electrically coupled to said pendant control circuit, said pendant power supply comprising at least one battery; and a desktop actuate unit being positionable on a horizontal support surface wherein said desktop actuate unit is configured to be accessible to the user, said desktop actuate unit being in remote communication with said plurality of light emitters, each of said light emitters being turned on when said desktop actuate unit is actuated by the user, said desktop actuate unit comprising:

a desktop housing having a lower wall and an upper wall, said lower wall resting on the horizontal support surface;

a desktop button being movably integrated into said upper wall wherein said desktop button is configured to be manipulated by the user, a desktop control circuit being integrated into said desktop housing, said desktop button being electrically coupled to said desktop control circuit, said desktop control circuit receiving a broadcast input when said desktop button is depressed;

a desktop transmitter being integrated into said desktop housing, said desktop transmitter being electrically coupled to said desktop control circuit, said desktop transmitter being in wireless communication with said receiver in said alert housing, said desktop transmitter broadcasting an alert signal when said desktop control circuit receives said broadcast input, said alert control circuit receiving said alert input when said receiver receives said alert signal from said desktop transmitter; and a desktop power cord being coupled to and extending away from said desktop housing, said desktop power cord being electrically coupled to said desktop control circuit, said desktop power cord being pluggable into a power source comprising a female electrical outlet.

* * * * *